US007396320B2

(12) United States Patent
Tchira

(10) Patent No.: US 7,396,320 B2
(45) Date of Patent: Jul. 8, 2008

(54) PRE-FOLDED AND PRE-GLUED FLOWER WRAP SHEETS AND METHODS FOR MAKING

(76) Inventor: Steven Tchira, 7551 NW. 52 St., Miami, FL (US) 33166

( * ) Notice: Subject to any disclaimer, the term of this patent is extended or adjusted under 35 U.S.C. 154(b) by 0 days.

(21) Appl. No.: 10/687,337

(22) Filed: Oct. 16, 2003

(65) Prior Publication Data

US 2005/0082353 A1 Apr. 21, 2005

(51) Int. Cl.
*B31B 1/26* (2006.01)

(52) U.S. Cl. ..... 493/231; 493/228; 493/240; 493/244; 53/397; 229/930; 206/423

(58) Field of Classification Search ..... 229/930; 493/228, 240, 396, 231, 244; 53/397, 399; 47/72, 42.01, 41.01; 206/423
See application file for complete search history.

(56) References Cited

U.S. PATENT DOCUMENTS

| | | | | |
|---|---|---|---|---|
| 1,520,647 | A | 12/1924 | Hennegan | |
| 1,697,751 | A | 1/1929 | Blake | |
| 2,247,191 | A * | 6/1941 | Endres | 206/423 |
| 2,302,259 | A | 11/1942 | Rothfus | |
| 2,529,060 | A | 11/1950 | Trillich | |
| 2,540,707 | A | 2/1951 | Buekelman | |
| 2,676,897 | A | 4/1954 | Trillich | |
| 2,736,427 | A * | 2/1956 | Trombetta | 206/423 |
| 3,271,922 | A | 9/1966 | Wallerstein | |
| 3,700,230 | A * | 10/1972 | Cook | 493/456 |
| 3,713,576 | A * | 1/1973 | Goebel | 229/128 |
| 4,055,292 | A * | 10/1977 | Hosoya | 229/100 |
| 4,410,129 | A * | 10/1983 | Wischusen, III | 229/117.06 |
| 4,493,419 | A | 1/1985 | Prader et al. | |
| 4,562,925 | A | 1/1986 | Pistner | |
| 4,595,389 | A | 6/1986 | Lehmacher | |
| 4,773,182 | A | 9/1988 | Weder et al. | |
| 4,779,996 | A | 10/1988 | Sengewald | |
| 4,811,417 | A | 3/1989 | Prince et al. | |

(Continued)

FOREIGN PATENT DOCUMENTS

| | | |
|---|---|---|
| DE | 11 37 672 B | 10/1962 |
| EP | 1120028 A1 | 8/2001 |
| FR | 1 432 770 A | 3/1966 |

OTHER PUBLICATIONS

International Design Registration DM/054728, Jan. 15, 2001.
International Design Registration DM/054766, Jan. 15, 2001.
International Design Registration DM/056163, May 30, 2001.
International Design Registration DM/056486, Jun. 25, 2001.
International Design Registration DM/057923, Oct. 3, 2001.
International Design Registration DM/060491, Apr. 8, 2002.
International Design Registration DM/060492, Apr. 8, 2002.

(Continued)

*Primary Examiner*—Christopher Harmon
(74) *Attorney, Agent, or Firm*—August Law Group LLC; George Willinghan

(57) ABSTRACT

A sheet of material is provided that is pre-folded and pre-glued for the wrapping and packaging of flower bunches and flower bouquets. The sheet of material contains a plurality of lines scored therein. The scored lines are arranged to create a pre-defined folding sequence that forms the desired floral packaging or wrapping. Visual indicia arranged to illustrate the pre-defined folding sequence and markings arranged to compliment the folded shape of the sheet are also provided. A fastening means is provided to secure the folded packaging. The sheet of material is made by scoring the sheet in particular places to mark the fold lines and to facilitate easy and consistent folding. The sheet is then folded across the scored lines and secured.

10 Claims, 6 Drawing Sheets

U.S. PATENT DOCUMENTS

| | | | | |
|---|---|---|---|---|
| 4,854,451 | A | 8/1989 | Jensen | |
| 4,897,031 | A | 1/1990 | Weder et al. | |
| 4,910,913 | A | 3/1990 | Streeter | |
| 4,917,240 | A * | 4/1990 | Roberts et al. | 206/232 |
| 5,029,412 | A | 7/1991 | Weder et al. | |
| 5,076,011 | A | 12/1991 | Stehouwer | |
| 5,076,874 | A | 12/1991 | Weder | |
| 5,106,662 | A | 4/1992 | Khayat | |
| 5,111,637 | A | 5/1992 | Weder et al. | |
| 5,127,817 | A | 7/1992 | Weder et al. | |
| 5,199,242 | A | 4/1993 | Weder et al. | |
| 5,208,027 | A | 5/1993 | Weder et al. | |
| 5,228,234 | A | 7/1993 | de Klerk et al. | |
| 5,332,610 | A | 7/1994 | Weder et al. | |
| 5,335,475 | A | 8/1994 | Weder et al. | |
| 5,419,437 | A | 5/1995 | Huseman | |
| 5,472,752 | A | 12/1995 | Weder et al. | |
| 5,489,453 | A | 2/1996 | Friesch | |
| 5,493,809 | A | 2/1996 | Weder et al. | |
| 5,501,060 | A | 3/1996 | Weder et al. | |
| 5,522,202 | A | 6/1996 | Weder et al. | |
| 5,546,699 | A | 8/1996 | Weder et al. | |
| 5,572,849 | A | 11/1996 | Weder et al. | |
| 5,572,851 | A | 11/1996 | Weder | |
| 5,581,938 | A | 12/1996 | Weder | |
| 5,595,022 | A | 1/1997 | Weder | |
| 5,595,023 | A | 1/1997 | Weder | |
| 5,595,024 | A | 1/1997 | Weder | |
| 5,595,298 | A | 1/1997 | Straeter | |
| 5,595,802 | A | 1/1997 | Weder et al. | |
| 5,613,347 | A | 3/1997 | Weder | |
| 5,615,535 | A | 4/1997 | Weder | |
| 5,615,774 | A | 4/1997 | Weder | |
| 5,616,377 | A | 4/1997 | Weder et al. | |
| 5,616,379 | A | 4/1997 | Weder et al. | |
| 5,616,380 | A | 4/1997 | Weder et al. | |
| 5,616,381 | A | 4/1997 | Weder et al. | |
| 5,617,703 | A | 4/1997 | Weder | |
| 5,623,809 | A | 4/1997 | Weder | |
| 5,624,723 | A | 4/1997 | Weder et al. | |
| 5,625,979 | A | 5/1997 | Weder | |
| 5,626,003 | A | 5/1997 | Weder | |
| 5,634,320 | A | 6/1997 | Weder | |
| 5,634,558 | A | 6/1997 | Weder | |
| 5,636,493 | A | 6/1997 | Weder | |
| 5,640,805 | A | 6/1997 | Weder | |
| 5,674,577 | A | 10/1997 | Weder et al. | |
| 5,677,020 | A | 10/1997 | Weder et al. | |
| 5,677,021 | A | 10/1997 | Weder et al. | |
| 5,681,625 | A | 10/1997 | Weder et al. | |
| 5,682,730 | A | 11/1997 | Dobreski | |
| 5,683,765 | A | 11/1997 | Weder et al. | |
| 5,687,845 | A | 11/1997 | Weder | |
| 5,704,161 | A | 1/1998 | Weder | |
| 5,716,474 | A | 2/1998 | Weder et al. | |
| 5,720,152 | A | 2/1998 | Weder | |
| 5,722,200 | A | 3/1998 | Weder | |
| 5,727,362 | A * | 3/1998 | Weder | 53/397 |
| 5,740,657 | A | 4/1998 | Weder | |
| 5,740,658 | A | 4/1998 | Weder | |
| 5,749,171 | A | 5/1998 | Weder | |
| 5,753,327 | A | 5/1998 | Weder et al. | |
| 5,758,772 | A | 6/1998 | Weder et al. | |
| 5,759,652 | A | 6/1998 | Weder et al. | |
| 5,761,880 | A | 6/1998 | Weder | |
| 5,765,306 | A | 6/1998 | Weder et al. | |
| 5,782,057 | A | 7/1998 | Weder | |
| 5,782,059 | A | 7/1998 | Weder | |
| 5,810,169 | A | 9/1998 | Weder | |
| 5,813,194 | A | 9/1998 | Weder | |
| 5,816,023 | A | 10/1998 | Weder | |
| 5,829,194 | A | 11/1998 | Weder | |
| 5,832,663 | A | 11/1998 | Weder et al. | |
| 5,836,095 | A * | 11/1998 | Crowell | 40/299.01 |
| 5,840,379 | A | 11/1998 | Weder et al. | |
| 5,842,569 | A | 12/1998 | Weder | |
| 5,846,618 | A | 12/1998 | Weder et al. | |
| 5,906,086 | A | 5/1999 | Weder | |
| 5,910,051 | A | 6/1999 | Weder | |
| 5,930,979 | A | 8/1999 | Weder | |
| 5,934,044 | A * | 8/1999 | Weder | 53/397 |
| 5,941,020 | A | 8/1999 | Weder | |
| 5,944,187 | A | 8/1999 | Weder | |
| 5,966,869 | A | 10/1999 | Weder | |
| 5,979,143 | A | 11/1999 | Weder | |
| 6,009,664 | A | 1/2000 | Weder | |
| 6,009,687 | A | 1/2000 | Weder | |
| 6,016,642 | A | 1/2000 | Weder | |
| 6,026,630 | A | 2/2000 | Weder | |
| 6,026,631 | A | 2/2000 | Weder | |
| 6,047,524 | A | 4/2000 | Weder | |
| 6,061,959 | A | 5/2000 | Weder | |
| 6,076,672 | A | 6/2000 | Weder | |
| 6,082,045 | A | 7/2000 | Weder et al. | |
| 6,089,446 | A | 7/2000 | Hirano | |
| 6,105,311 | A | 8/2000 | Weder | |
| 6,112,503 | A | 9/2000 | Weder | |
| 6,119,860 | A | 9/2000 | Weder | |
| 6,123,194 | A | 9/2000 | Weder et al. | |
| 6,135,284 | A | 10/2000 | Weder | |
| 6,136,393 | A | 10/2000 | Weder | |
| 6,138,409 | A * | 10/2000 | Weder | 47/58.1 R |
| 6,141,906 | A | 11/2000 | Weder | |
| 6,151,831 | A | 11/2000 | Weder et al. | |
| 6,152,301 | A | 11/2000 | Weder | |
| 6,158,777 | A * | 12/2000 | Twardosz | 283/62 |
| 6,161,330 | A | 12/2000 | Weder | |
| 6,173,553 | B1 | 1/2001 | Weder | |
| 6,178,689 | B1 | 1/2001 | Weder | |
| 6,179,126 | B1 | 1/2001 | Smithson et al. | |
| 6,182,396 | B1 | 2/2001 | Weder | |
| 6,185,904 | B1 | 2/2001 | Weder et al. | |
| 6,187,403 | B1 | 2/2001 | Richardson | |
| 6,189,290 | B1 | 2/2001 | Weder | |
| 6,195,963 | B1 | 3/2001 | Weder | |
| 6,202,347 | B1 | 3/2001 | Weder | |
| 6,212,856 | B1 | 4/2001 | Weder | |
| 6,269,590 | B1 | 8/2001 | Weder | |
| 6,279,296 | B1 | 8/2001 | Weder | |
| 6,301,861 | B1 | 10/2001 | Weder | |
| 6,305,147 | B1 | 10/2001 | Weder | |
| 6,327,817 | B1 | 12/2001 | Weder | |
| 6,341,446 | B2 | 1/2002 | Weder et al. | |
| 6,343,456 | B2 | 2/2002 | Weder | |
| 6,347,481 | B1 | 2/2002 | Weder | |
| 6,354,985 | B2 * | 3/2002 | Huber | 493/458 |
| 6,357,205 | B1 | 3/2002 | Weder | |
| 6,367,229 | B1 | 4/2002 | Weder | |
| 6,385,904 | B1 | 5/2002 | Weder | |
| 6,385,906 | B2 | 5/2002 | Weder | |
| 6,385,907 | B2 | 5/2002 | Weder et al. | |
| 6,401,388 | B2 | 6/2002 | Weder | |
| 6,401,431 | B2 | 6/2002 | Weder | |
| 6,410,119 | B1 * | 6/2002 | De Luca et al. | 428/166 |
| 6,421,958 | B2 | 7/2002 | Weder | |
| 6,427,380 | B2 | 8/2002 | Weder et al. | |
| 6,442,894 | B2 | 9/2002 | Weder | |
| 6,446,811 | B1 | 9/2002 | Wilfong, Jr. | |
| 6,457,296 | B1 | 10/2002 | Weder | |
| 6,460,291 | B1 | 10/2002 | Weder | |
| 6,463,718 | B2 | 10/2002 | Weder | |
| 6,467,218 | B2 | 10/2002 | Weder | |
| 6,470,624 | B2 | 10/2002 | Weder | |
| 6,474,020 | B2 | 11/2002 | Alcazar et al. | |

6,474,043 B1 11/2002 Weder et al.
6,477,804 B2 11/2002 Weder et al.
6,484,442 B1 * 11/2002 Weder ..... 47/72
6,484,443 B2 11/2002 Weder
6,493,989 B2 12/2002 Weder
6,499,250 B2 12/2002 Weder
6,502,351 B2 1/2003 Weder
6,508,588 B1 1/2003 Meyer et al.
6,510,651 B2 1/2003 Weder et al.
6,510,652 B2 1/2003 Weder
6,513,302 B2 2/2003 Weder
6,519,896 B2 2/2003 Weder
6,519,897 B2 2/2003 Weder
6,519,915 B2 2/2003 Weder
6,523,304 B2 2/2003 Weder
6,523,305 B2 2/2003 Weder et al.
6,523,327 B2 2/2003 Weder
6,530,193 B2 3/2003 Weder
6,532,698 B2 3/2003 Weder
6,536,185 B2 3/2003 Weder et al.
6,536,186 B2 3/2003 Weder
6,536,951 B1 3/2003 Sill
6,539,667 B2 4/2003 Weder
6,539,668 B2 4/2003 Weder
6,543,184 B2 4/2003 Weder et al.
6,571,536 B2 6/2003 Weder et al.
6,574,920 B1 6/2003 Weder
6,575,300 B2 6/2003 Meyer et al.
6,578,345 B2 6/2003 Weder
6,584,729 B2 7/2003 Weder
6,588,148 B2 7/2003 Weder et al.
6,594,952 B2 7/2003 Weder
6,595,409 B2 * 7/2003 Hashimoto et al. ..... 229/108
6,598,343 B2 7/2003 Weder
6,598,344 B2 7/2003 Weder
6,601,344 B2 8/2003 Weder
6,601,707 B2 8/2003 DeSmedt
6,604,341 B2 8/2003 Weder
6,604,674 B1 * 8/2003 Bowman ..... 229/116.5
6,606,838 B2 8/2003 Weder
6,618,991 B2 9/2003 Weder
6,625,930 B2 9/2003 Weder
6,637,154 B2 10/2003 Weder
6,658,791 B2 12/2003 Weder
6,662,495 B2 12/2003 Weder et al.
6,725,626 B2 4/2004 Weder
6,735,904 B2 5/2004 Weder
6,739,090 B2 5/2004 Weder
6,739,091 B2 5/2004 Weder
6,742,316 B2 6/2004 Weder et al.
6,758,011 B2 7/2004 Weder
6,761,011 B2 7/2004 Weder et al.
6,769,225 B2 8/2004 Weder
6,782,657 B2 8/2004 Weder
6,782,658 B2 8/2004 Weder
6,786,003 B2 * 9/2004 Gilbert ..... 47/72
6,786,004 B2 9/2004 Weder
6,789,356 B2 9/2004 Weder
6,789,372 B2 9/2004 Weder
6,796,104 B1 9/2004 Weder
6,810,638 B2 11/2004 Weder
2001/0009082 A1 7/2001 Weder
2001/0013480 A1 8/2001 Weder
2001/0045058 A1 11/2001 Weder et al.
2002/0040547 A1 4/2002 Weder et al.
2002/0043020 A1 4/2002 Weder
2002/0043021 A1 4/2002 Weder
2002/0046491 A1 4/2002 Weder
2002/0053162 A1 5/2002 Weder
2002/0056228 A1 5/2002 Weder
2002/0062595 A1 5/2002 Weder
2002/0100213 A1 8/2002 Weder
2002/0108304 A1 8/2002 Weder
2002/0112402 A1 8/2002 Weder
2002/0134016 A1 9/2002 Weder
2002/0157311 A1 10/2002 Weder
2002/0184822 A1 12/2002 Weder
2002/0189165 A1 12/2002 Weder
2002/0189167 A1 12/2002 Weder
2003/0029084 A1 2/2003 Weder
2003/0040859 A1 2/2003 Weder
2003/0051401 A1 3/2003 Weder
2003/0051402 A1 3/2003 Weder
2003/0066235 A1 4/2003 Weder
2003/0070359 A1 4/2003 Weder
2003/0079405 A1 5/2003 Weder
2003/0097791 A1 5/2003 Weder
2003/0097792 A1 5/2003 Weder
2003/0106265 A1 6/2003 Weder
2003/0110689 A1 6/2003 Weder
2003/0110691 A1 6/2003 Weder
2003/0115748 A1 6/2003 Weder
2003/0131531 A1 7/2003 Weder
2003/0136696 A1 7/2003 Weder
2003/0159353 A1 8/2003 Weder
2003/0192247 A1 10/2003 Weder
2003/0192248 A1 10/2003 Weder
2003/0196378 A1 10/2003 Weder
2003/0200698 A1 10/2003 Weder
2003/0213174 A1 11/2003 Weder
2003/0217510 A1 11/2003 Weder
2004/0000091 A1 1/2004 Weder et al.
2004/0020119 A1 2/2004 Weder
2004/0025431 A1 2/2004 Weder
2004/0031200 A1 2/2004 Weder
2004/0035051 A1 2/2004 Weder
2004/0040203 A1 3/2004 Weder
2004/0040207 A1 3/2004 Weder
2004/0040208 A1 3/2004 Weder
2004/0049981 A1 3/2004 Weder
2004/0068927 A1 4/2004 Weder
2004/0079030 A1 4/2004 Weder
2004/0088919 A1 5/2004 Weder
2004/0093794 A1 5/2004 Weder
2004/0159045 A1 8/2004 Weder
2004/0194378 A1 10/2004 Weder
2004/0250471 A1 12/2004 Weder
2005/0000158 A1 1/2005 Weder
2005/0005517 A1 1/2005 Weder et al.
2005/0011115 A1 1/2005 Weder
2005/0011121 A1 1/2005 Weder

OTHER PUBLICATIONS

International Design Registration DM/060496 Apr. 11, 2002.
International Design Registration DM/062489, Nov. 7, 2002.
International Design Registration DM/063987, Jul. 7, 2003.
International Design Registration DM/064040, Jul. 10, 2003.
International Design Registration DM/064042, Jul. 7, 2003.
International Design Registration DM/064043, Jul. 7, 2003.
International Design Registration DM/064212, Aug. 27, 2003.
International Design Registration DM/048994, Aug. 9, 1999.
International Design Registration DM/065146, Mar. 10, 2004.
International Design Registration DM/065197, Feb. 16, 2004.
International Design Registration DM/050038, Dec. 6, 1999.
Benelux Design Registration 14490-00, Jun. 1986.
Benelux Design Registration 25734-00, Aug. 1995.
European Community Design Registration 000197884-0001, Jul. 6, 2004.
European Community Design Registration 000207873-0001, Jul. 30, 2004.
International Search Report Mailed Feb. 1, 2005 in related International Application No. PCT/US2004/033758.

* cited by examiner

PRE-FOLDED AND PRE-GLUED FLOWER WRAP SHEETS AND METHODS FOR MAKING

FIELD OF THE INVENTION

This invention relates to materials and methods for wrapping plants and floral arrangements.

BACKGROUND OF THE INVENTION

Conventional packages for wrapping floral arrangements and flower bunches use one or more sheets of paper or film. To wrap a flower bunch, square or rectangular sheets of the paper or film are folded by hand around the flower bunch. Depending on the look the flower packer wants to achieve, the complexity of the folding may vary. More complex arrangements have more folds and require more time and labor to complete. Increased time and labor result in an increased cost of producing folded sheets for wrapping flower bunches. This increased cost can exceed the target cost that customers wish to pay for the flower wraps.

In addition to cost and pricing limitations, the paper and film sheets lack guides or indications showing how to fold the sheets, making it difficult for both manufacturers and end-users to achieve a consistent finished product. One solution to cost and pricing limitations is the flower sleeve. The flower sleeve is a conical shaped bag that is open at the top and at the bottom. Flower sleeves are available in many different sizes to meet the customer's need to properly pack the flowers and floral arrangements of varying size. Also, flower sleeves are produced in conventional bag making machines that make this an easily replicable product. Therefore, consistency from one unit to the other is achieved. Although flower sleeves are convenient and relatively inexpensive to produce, these sleeves lack the hand-wrapped appearance and decorative aspects of a folded sheet.

SUMMARY OF THE INVENTION

In accordance with the present invention, a sheet of material, for example paper, plastic film or fabric, is pre-folded and pre-glued for the wrapping and packaging of flower bunches and floral bouquets. The sheet of material has a first unfolded position and a second folded position and is moveable from the first position to the second position by folding in a pre-defined sequence along a plurality of lines scored into the sheet of material. The scored lines are arranged to create the pre-defined folding sequence that forms the desired floral packaging or wrapping, preferably having a decorative, hand-wrapped appearance.

The sheet of material can also include visual indicia arranged to illustrate the pre-defined folding sequence and markings arranged to compliment the folded shape of the sheet. A fastening means is provided on a least a portion of the sheet of material to secure the sheet of material in the second folded position. In addition to providing for a single type of packaging, the sheet of material can include a plurality of second folded positions, each one of the plurality of second positions corresponding to a distinct package based upon the folding sequence used when moving the sheet of material from the first position to the second position.

The process can begin by scoring the sheet to mark the fold lines and to make the folding process easy for the person folding the sheet and consistent from one sheet to the next. The sheet of material can also be folded by hand or by a machine. Once all folds in the sheet have been made, portions of the sheet which overlap are secured together, for example by gluing, to create the desired floral package. The sheet of material can be shipped folded and secured or can be shipped flat for folding by the end users.

BRIEF DESCRIPTION OF THE DRAWINGS

In the accompanying drawings that form a part of the specification and are to be read in conjunction therewith and in which like reference numerals are used to indicate like parts in the various views.

DETAILED DESCRIPTION

Figure 1:
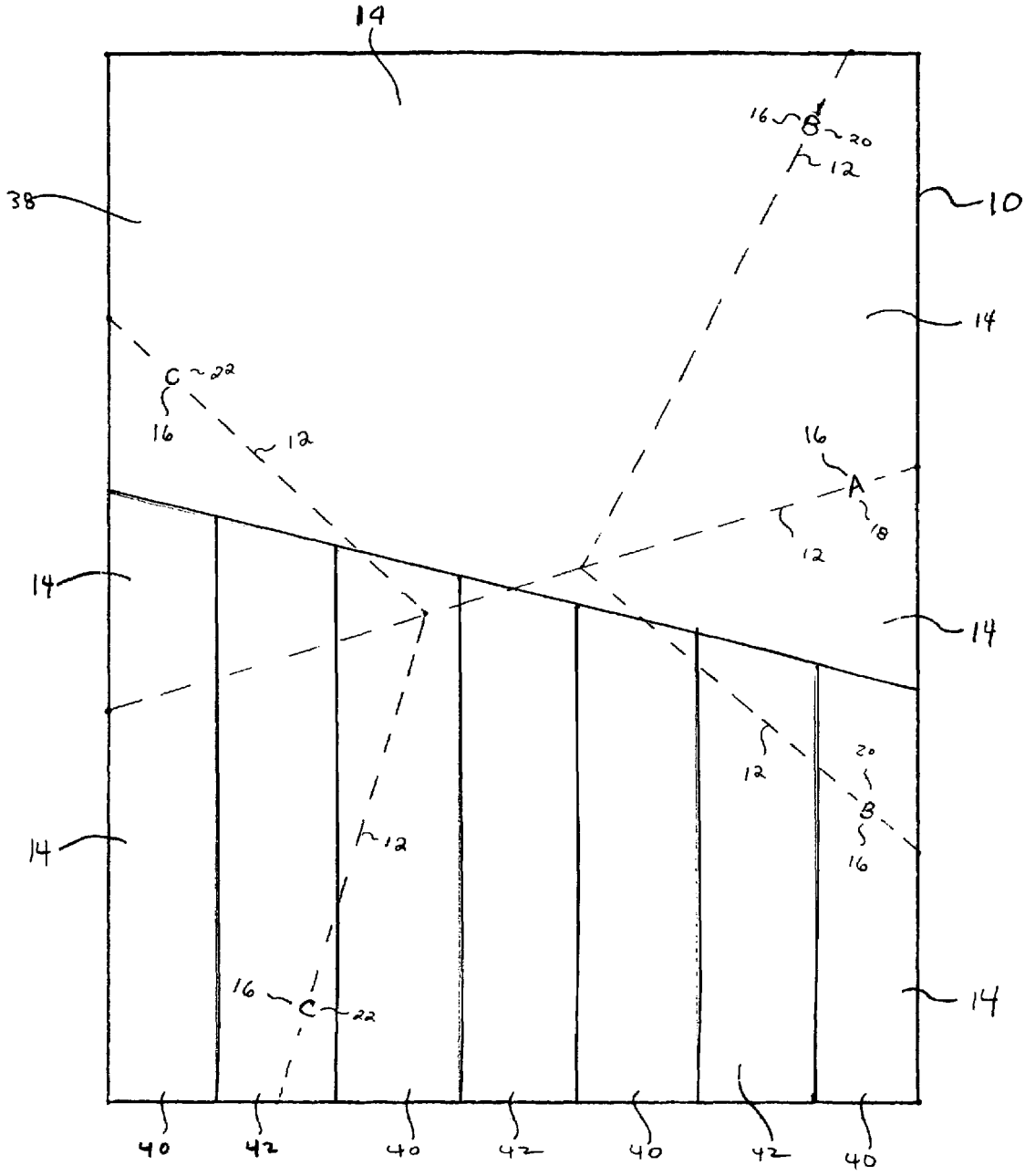
FIG. 1 is a plan view of an embodiment of a sheet of material in an unfolded position in accordance with the present invention.

Referring initially to FIG. 1, a sheet of material 10 in accordance with the present invention is illustrated. The sheet of material 10 can be any geometric shaped desired, for example, circular, triangular, rectangular and square. In addition to regular geometric shapes, the sheet of material 10 can be arranged as a combination of geometric shapes to create an irregular look. In general, the sheet of material 10 is a substantially two dimensional sheet of material having a thickness of from about 0.1 mils up to about 30 mils, preferably about 0.5 mils up to about 10 mils, more preferably from about 1 mil up to about 5 mils.

Suitable materials for the sheet of material 10 are selected to be generally flexible and foldable. These materials can be arranged as a single layer or as a laminate of two or more layers. Examples of suitable materials include paper, cardboard, metal foils, plastic or polymer films including polypropylene, polyethylene and cellophane films, non-polymer films, fabrics including woven, non-woven, natural and synthetic, fibers, cloths, burlaps and combinations thereof. Preferably, the materials are selected to be suitable for use as packaging or wrapping for flowers, plants and floral arrangements. The sheet of material 10 can be opaque, translucent, transparent and combinations thereof. The opaque, translucent and transparent appearance of the sheet of material 10 can be an inherent quality of the materials from which the sheet is constructed or can be the result of colors, objects, alpha-numeric characters and designs that are printed onto the sheet of material 10.

As illustrated in FIG. 1, the sheet of material 10 is in a first, unfolded position wherein the sheet of material 10 is substantially flat. Disposed on either the front or back or both the front and back of the sheet of material 10 are a plurality of intersecting lines 12. The lines 12 divide the sheet of material 10 into a plurality of sections 14. Although the lines 12 can be printed, for example using ink, embossed or etched on the sheet of material 10, preferably the lines 12 are scored in the sheet of material. The plurality of lines 12 are arranged to define the lines across which the sheet of material 10 is folded into a second position. In this second position, the sheet of material 10 forms a package, holder or wrapping having a pre-determined shape as shown, for example, in FIG. 2. Preferably, the pre-determined shape is suitable to hold flowers, plants and floral arrangements.

In addition to the location of the fold lines in the sheet of material 10, the sequence of folding the sheet of material 10 across the plurality of lines 12 also contributes to the final appearance and function of the package formed when the sheet of material is moved from the first position to the second position. In one embodiment, the plurality of lines 12 are scored so as to create a pre-defined sequence for folding the sheet of material 10 in order to achieve the desired package shape. Therefore, the scored lines 12 act as creases so that the sheet of material 10 inherently folds across the lines 12 in the proper, pre-determined order or sequence.

In another embodiment, the sheet of material 10 also includes visual alpha-numeric indicia 16 or written instructions disposed adjacent or integrated within the lines 12 and arranged to illustrate the pre-defined folding sequence. The visual indicia 16 can be disposed on either the front or back of the sheet of material 10, and are placed on the sheet of material by any suitable method known in the art including printing, etching and embossing. Preferably, the visual indicia 16 are placed on the sheet of material so that after a first fold has been made across the line having the first visual indicia 18, subsequent indicia are readily viewable. However, the visual indicia 16 do not detract from the final appearance of the package and are preferably hidden from view when the sheet of material 10 is in the second position.

The process for forming the sheet of material 10 into packaging is illustrated in FIGS. 1 and 3-5. The desired appearance of the package constructed from the sheet of material 10 is selected, and the necessary arrangement of lines 12 in the sheet of material and the sequence of folding the sheet of material 10 across the lines 12 is determined. Next, the plurality of intersecting lines 12 are scored in the sheet of material 10 in the pre-determined arrangement. The method of scoring the lines 12 varies depending on the type material used. In one embodiment, a die is used to apply the scoring via pressure. In another embodiment, the sheet of material 10 is constructed of paper, and a plurality of sheets of paper are simultaneously scored with the desired arrangement of lines. In yet another embodiment, the sheet of material 10 is constructed from a film material, for example a polymer film, and a single film sheet is scored using a metallic die. Other methods for scoring the plurality of lines 12 in the selected sheet of material 10 are available as would be understood by one of skill in the art.

After scoring, the folding angle is defined, thus allowing the operator to easily fold the sheets using the scores on the sheet as guides. The plurality of lines 12 can also printed on the sheet of material 10, and, if desired, the visual folding sequence indicia 16 are added or printed on the sheet of material 10.

The sheet of material 10 is then folded in the sequence defined by the plurality of scored lines 12 and illustrated by the visual indicia 16. Alternatively, the sheet of material 10 can be folded, either by hand or by a machine, without first scoring the plurality of lines 12 in the sheet of material. In this embodiment, the machine would fold a completely flat and non-scored sheet of material 10 in the proper sequence to form the pre-determined package shape. In either embodiment, the same sequence and arrangement for folding can be used to produce the same pre-determined packages.

Figure 3:
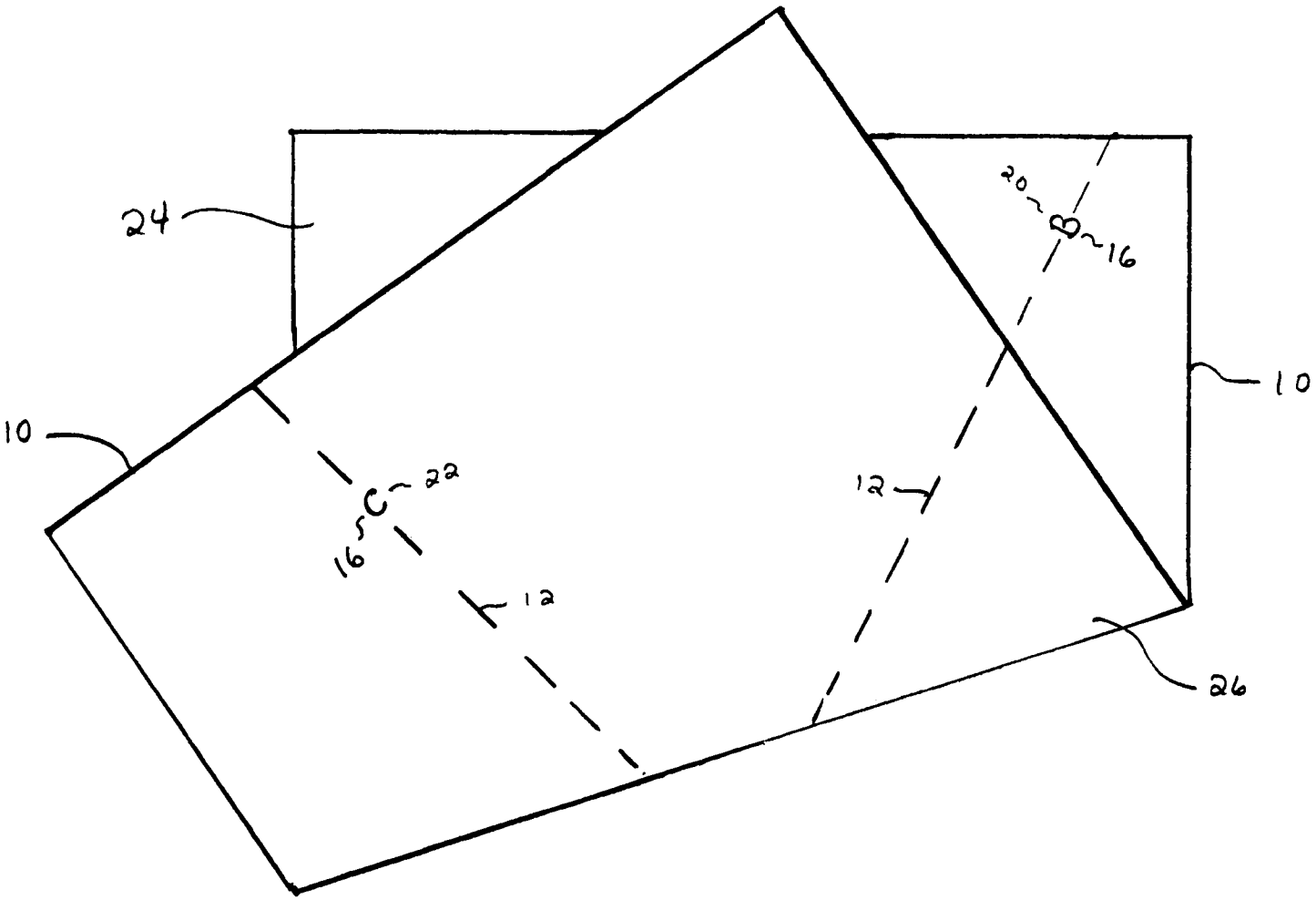
FIG. 3 is a front view of an embodiment of a sheet of material in a first partially folded position.

As shown in FIG. 3, the sheet of material 10 is folded across the scored line containing the first visual indicia 18. Once folded, the second visual indicia 20 are visible. If in addition to being scored, the lines are also printed, the lines containing the second visual indicia are also visible. In one embodiment, the printed lines 12 are visible because the lines are printed on the front 24 of the sheet of material 10, and the sheet of material 10 is transparent or translucent. Alternatively, the lines 12 are printed on both the front 24 and the back 26 of the sheet of material 10. Since the lines 12 can actually be scored into the sheet of material 10 so as to indicate both the location of the lines and sequence of folding, printing of the lines 12 or alpha-numeric indicia 16 is optional.

Figure 4:
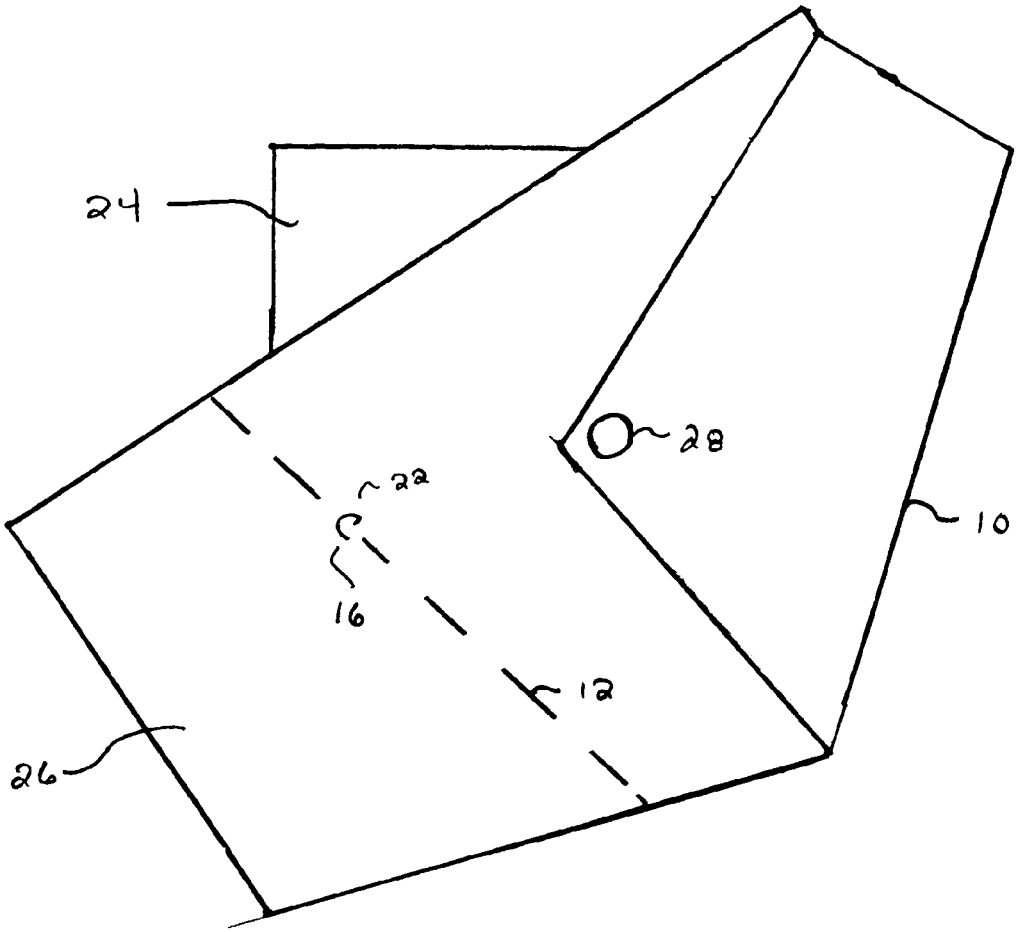
FIG. 4 is a front view of an embodiment of a sheet of material in a second partially folded position.

As shown in FIG. 4, the sheet of material is folded across the scored line 12 containing the second visual indicia 20. Once folded, the next or third visual indicia 22 are visible. Next, the sheet of material 10 is folded across the line 12 containing the third visual indicia 22 to create the pre-determined package illustrated in FIG. 5. Although five intersecting fold lines defining a three-step folding sequence is illustrated, the number of fold lines is not limited to five but is determined by the desired final shape of the package.

The sheet of material 10 is then secured in the pre-determined package shape. As shown in FIG. 4, the sheet of material is secured in the pre-determined shape by applying a fastening means 28 to at least one portion of the sheet of material 10. Alternatively, the fastening means is applied to a plurality of locations across the sheet of material. Preferably, the portions of the sheet of material 10 containing the fastening means 28 overlap when the sheet of material is in the second, folded position. Any fastening means capable of bonding one location on the sheet of material to another can be used. The fastening means can fixedly or releasably secure the sheet of material in the pre-determined shape. Suitable fastening means include adhesives, double-sided tape, mechanical fasteners, direct bonds and combinations thereof. Once the sheet of material has been scored, folded and secured, the particular place where the scoring has been made will prevent the material from loosing the defined fold. In other words, the fold will stay in place.

Once folded and secured, the package is then shipped to the end user. This method facilitates the efficient manufacture of a consistent package for holding flowers, floral arrangements and plants. In an alternative embodiment, the sheet of material 10 can be shipped to the end user as a flat, scored sheet before folding and securing. Since the sheet of material is scored, the end user can easily and consistently fold the sheet into the desired package shape. In this embodiment, the fastening means 28 is applied to the sheet of material 10 in the proper location. A preferred fastening means in this embodiment is double-sided tape.

Figure 2:
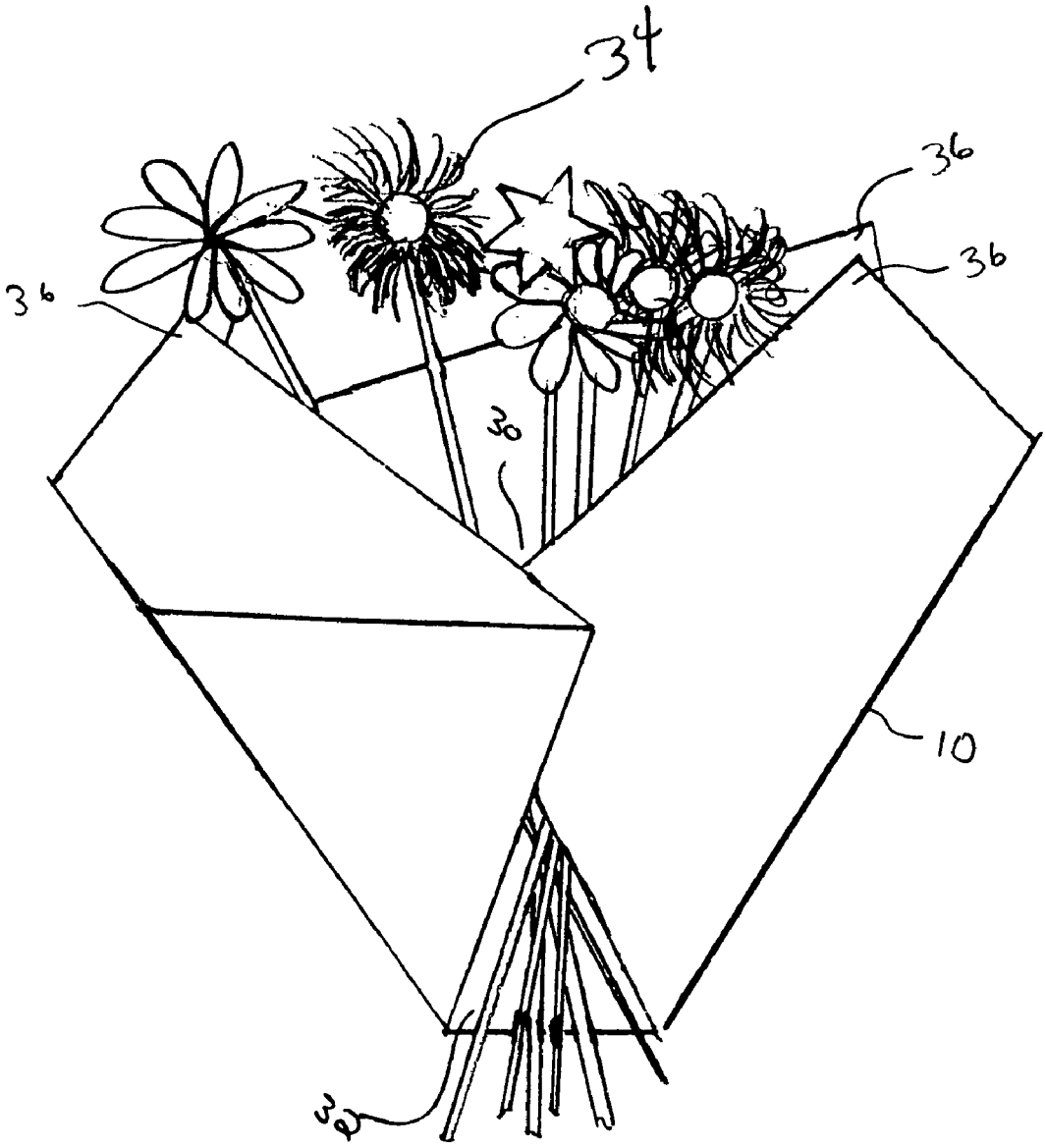
FIG. 2 is a front view of the sheet of material in a folded position holding a floral arrangement.
Figure 5:
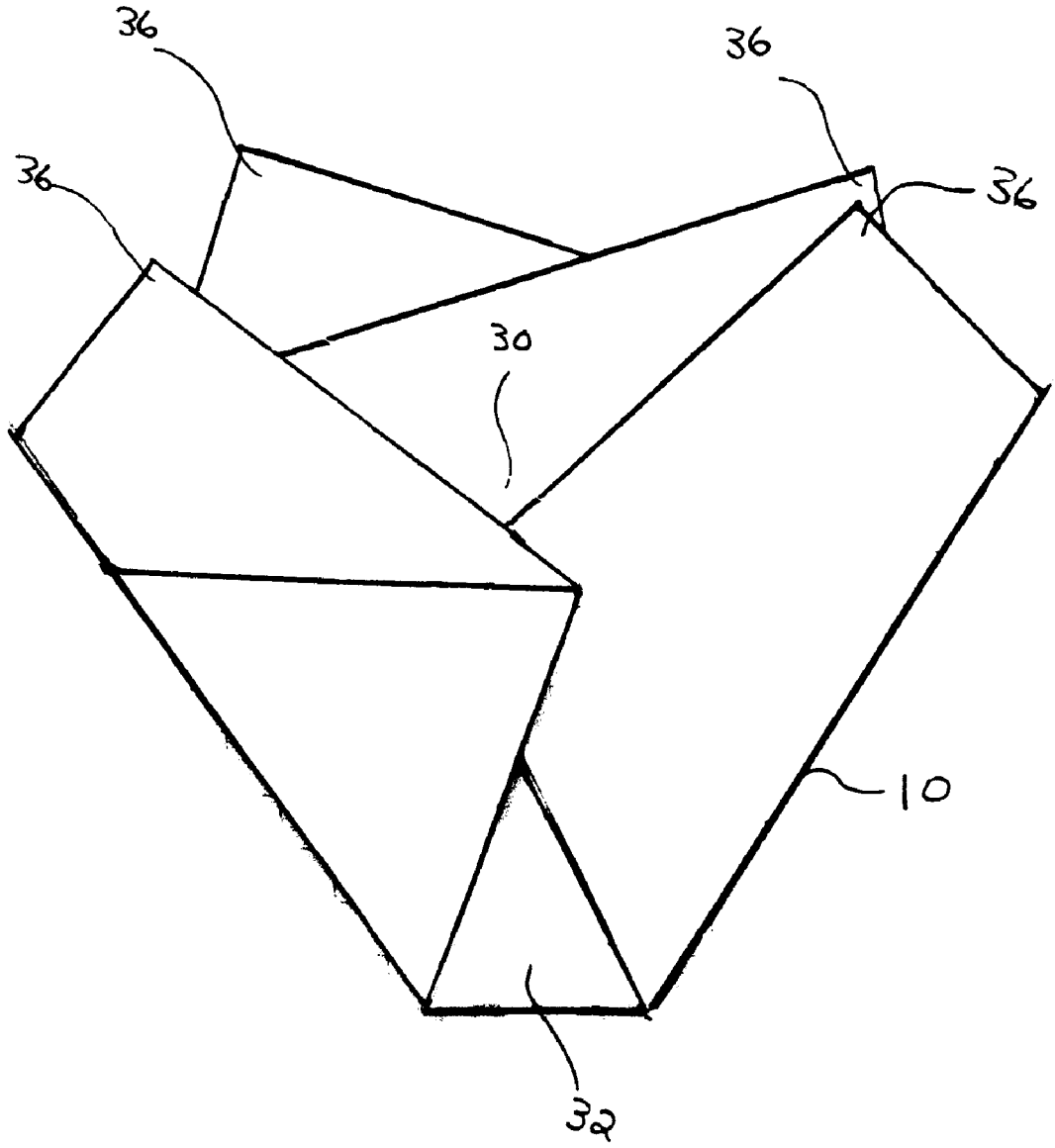
FIG. 5 is a front view of an embodiment of a sheet of material in a folded position.

As illustrated in FIG. 5, the predetermined shape in one embodiment is generally conical having an open top 30 and bottom 32 and a plurality of peaked or pointed sections 36. This facilitates the placement of floral arrangements 14 in the package (FIG. 2). Although illustrated as a conical flower wrap, other package shapes are possible. In one embodiment, the pre-determined shape has the appearance of being wrapped by hand. In another embodiment, the pre-determined shape has the appearance of multiple overlapping layers of wrap.

The pre-determined shape can be enhanced by using an arrangement of markings disposed across the sheet of material 10 and arranged to produce a selected appearance when the sheet is in the second position. In one embodiment, this selected appearance is arranged to compliment the folded shape of the sheet of material 10. Suitable markings include arrangements of opaque, translucent and transparent areas. These areas can be an inherent quality of the sheet of material 10 or can be printed or otherwise placed on the sheet of material 10. The markings can be uniform or can vary across the entire sheet of material 10. In addition, the markings can correspond to the plurality of lines 12. For example, the markings can vary among the various sections 14 defined by the lines 12. In one embodiment as shown in FIG. 1, the markings include a portion containing a first translucent color 38 and a portion containing transparent areas 40 and areas having a second translucent color 42. In general, the markings are selected based upon the desired final appearance of the package. For example, in a conical package embodiment, the markings can be selected to produce a generally conical shaped packaged having the appearance of a generally translucent, colored inner wrap surrounded by a generally transparent outer wrap.

Figure 6:
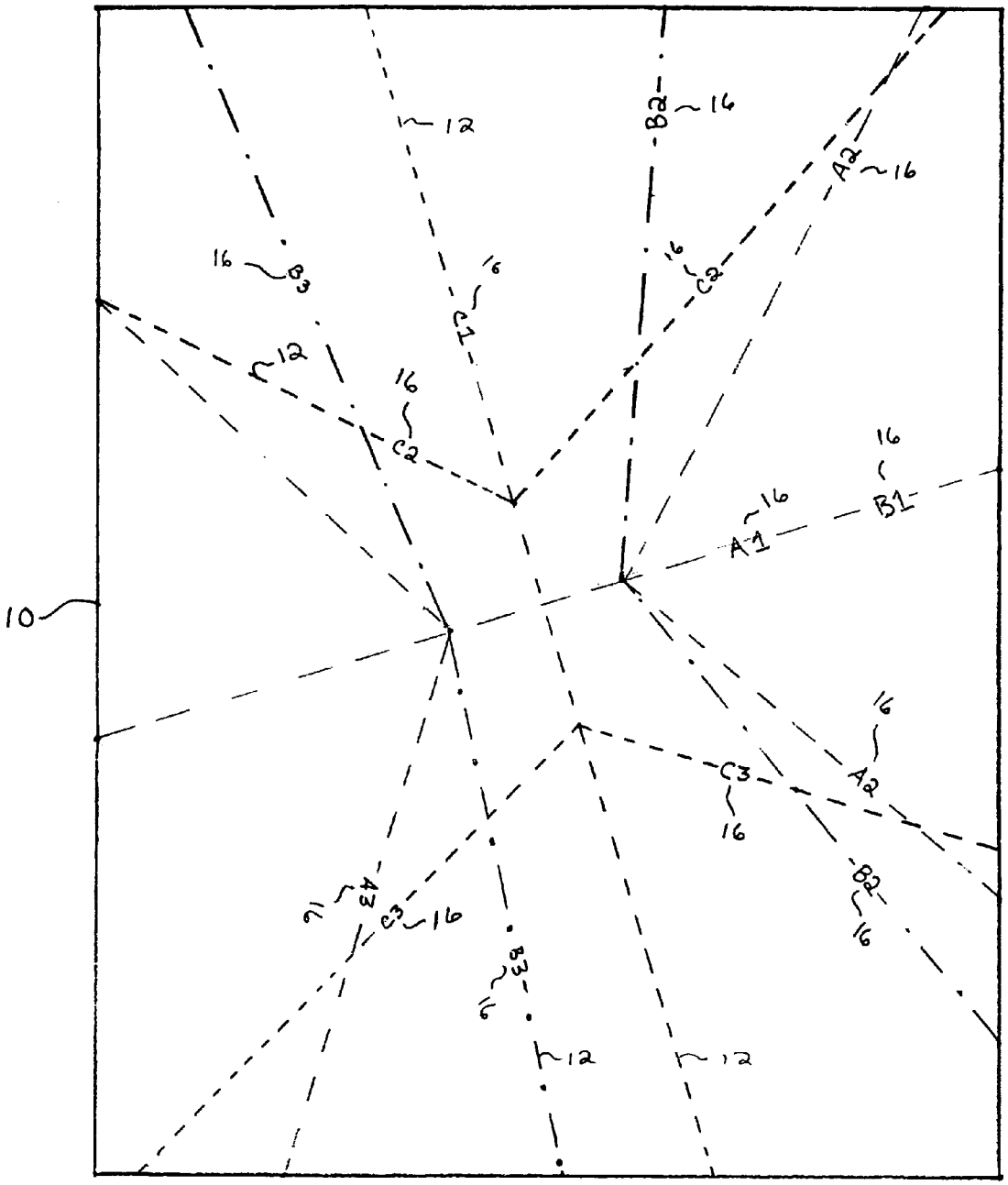
FIG. 6 is a plan view of an alternative embodiment of a sheet of material in an unfolded position.

In another embodiment of the present invention as illustrated in FIG. 6, a single sheet of material can be arranged to have a plurality of second positions. Each second position corresponds to a distinct package. The plurality of lines 12 are arranged to define each one of the distinct packages based upon the folding sequence used when moving the sheet of material 10 from the first position to the second position. In order to make a sheet of material 10 in accordance with this embodiment, a plurality of lines 12 defining a plurality of distinct folding sequences are scored into the sheet of material. The desired package and associated folding sequence is then selected, and the sheet of material 10 is folded in accordance with the selected folding sequence. Distinct printed lines and visual alpha-numeric indicia 16 can be applied to the sheet of material to indicate the proper groupings and folding sequences of lines, for example A1-A3, B1-B3 and C1-C3. In addition, the indicia 16 can indicate the final package shape for a given selection of lines 12.

The present invention uses a scoring system to facilitate production line assembly of the flower containers and wraps. Using the sheets and methods in accordance with the present invention, a large number of flower wraps can be produced having substantially the same appearance. The present invention facilitates the production of the floral wrap in a timely fashion. For example, when a customer places an order, an expected delivery date is specified. The expected delivery date in many cases is set by the flora holiday, for example Valentines Day. The flower packer will not have enough time to purchase flat sheets and fold them into wraps. Therefore, the flower packer needs the wraps provided folded. Moreover, if the wraps are not delivered to the bouquet packers prior to the designated holiday, the opportunity to sell these wraps will have lapsed at least for one year and possibly completely lost. If one would try to make all these wraps by hand with no scoring, then it would greatly hinder production efficiency. In addition, the present invention resolves the technical problem of being able to produce these at a reasonable and comparable cost to producing a flower sleeve.

The invention described and claimed herein is not to be limited in scope by the specific embodiments herein disclosed, since these embodiments are intended as illustrations of several aspects of the invention. Any equivalent embodiments are intended to be within the scope of this invention. Indeed, various modifications of the invention in addition to those shown and described herein will become apparent to those skilled in the art from the foregoing description. Such modifications are also intended to fall within the scope of the appended claims.

What is claimed is:

1. A pre-folded flower wrap comprising:

a single folded rectangular sheet of material comprising a single layer and a plurality of scored intersecting lines, the plurality of scored intersecting lines defining distinct sections in the single sheet of material and a distinct folding sequence when moving the sheet of material from an unfolded position to a folded position comprising a pre-determined folded shape, the folding sequence comprising a first fold across a scored line that defines two of the distinct sections, the first fold overlapping the two distinct sections of the single sheet of material to create two layers from the single sheet of material and subsequent folds that position one layer as an inner wrap and one layer as an outer wrap, the outer wrap surrounding the inner wrap, and that form the single sheet of material into the pre-determined folded shape comprising an overlapping portion, a plurality of peaked sections comprising corners of the rectangular sheet and multiple layers of flower wrap that comprise two separate layers of flower wrap, the inner wrap layer and the outer wrap layer, each separately wrapped completely around a floral arrangement such that both layers surround the floral arrangement and the outer layer surrounds the inner layer, wherein the pre-determined folded shape further comprises the functionality of a flower sleeve to facilitate placement of the floral arrangement within the multiple layers of flower wrap without having to wrap either layer of flower wrap around the floral arrangement.

2. The pre-folded flower wrap of claim 1, wherein the sheet of material further comprises visual indicia arranged to illustrate the folding sequence.

3. The pre-folded flower wrap of claim 1, wherein the sheet of material further comprises a fastening means disposed on the overlapping portion when the sheet of material is in the folded position to secure the pre-folded flower wrap in the pre-determined shape.

4. The pre-folded flower wrap of claim 3, wherein the fastening means comprises adhesive, double-sided tape, mechanical fasteners, direct bonds or combinations thereof.

5. The pre-folded flower wrap of claim 1, wherein the pre-determined shape is generally conical having an open top and bottom.

6. The pre-folded flower wrap of claim 1, wherein the sheet of material further comprises translucent markings disposed in one of the two distinct sections of the sheet of material that becomes the inner wrap, the other one of the two distinct sections that becomes the outer wrap comprising a transparent area and the folding sequence overlaps and aligns the transparent area and the distinct section containing the translucent markings to produce when the sheet is in the folded position a generally translucent inner wrap surrounded by a transparent outer wrap.

7. The pre-folded flower wrap of claim 6, wherein the translucent markings completely fill the distinct section of the sheet of material defined by the scored line across which the first fold is made.

8. The pre-folded flower wrap of claim 1, wherein the sheet of material further comprises a plurality of folded positions, each one of the plurality of folded positions corresponding to a distinct pre-folded flower wrap, the plurality of scored intersecting lines defining a plurality of distinct folding sequences, each one of the distinct folding sequences associated with one of the folded positions and used when moving the sheet of material from the unfolded position to the desired folded position.

9. A pre-folded flower wrap comprising:

a single folded sheet of material comprising:

a plurality of scored intersecting lines, the plurality of intersecting lines defining distinct sections in the single sheet of material and a distinct folding sequence when moving the sheet of material from an unfolded position to a folded position;

a first one of the distinct sections comprising a transparent area; and opaque marking filling a second one of the distinct sections of the single sheet of material to produce a selected appearance when the single sheet is in the folded position;

wherein the folding sequence comprising a first fold across a line that defines the first and second distinct sections and that overlaps the transparent area and the opaque marking filled section to form two layers, a transparent outer wrap layer and an opaque inner wrap layer, from the single sheet of material and subsequent folds that to produce a pre-determined folded shape comprising an opaque inner wrap surrounding a floral arrangement and surrounded by a transparent outer wrap and of the opaque inner wrap and the transparent outer wrap each separately wrapped completely around the floral arrangement when the sheet is in the folded position.

10. The pre-folded flower wrap of claim 9, wherein the sheet of material comprises a single layer.

* * * * *